United States Patent [19]

Switzer

[11] Patent Number: 4,663,004

[45] Date of Patent: May 5, 1987

[54] ELECTROCHEMICAL CONVERSION USING ALTERNATING CURRENT AND SEMICONDUCTOR ELECTRODES

[75] Inventor: Jay A. Switzer, Placentia, Calif.

[73] Assignee: Union Oil Company of California, Los Angeles, Calif.

[21] Appl. No.: 857,036

[22] Filed: Apr. 29, 1986

[51] Int. Cl.[4] ..... C25B 1/02

[52] U.S. Cl. ..... 204/129; 204/228; 429/111

[58] Field of Search ..... 204/129, 228; 429/111

[56] References Cited

U.S. PATENT DOCUMENTS 2,385,410 9/1945 Gardner et al. ..... 204/72
3,400,305 9/1968 Coffman et al. ..... 317/231
4,406,869 8/1984 Ayers ..... 204/129
4,414,080 11/1983 Williams et al. ..... 204/129

OTHER PUBLICATIONS

Alkire, R. C. and Tsai, J. E., *J. Electrochemical Soc.*, vol. 129, pp. 1157–1158.

*Primary Examiner*—R. L. Andrews
*Attorney, Agent, or Firm*—Dean Sandford; Gregory F. Wirzbicki; Alan H. Thompson

[57] ABSTRACT

A method for electrochemical converting reactants to products includes cycling alternating electrical current to an electrode containing a non-degenerate semiconductor material in an electrochemical cell. Suitably doped (n-type or p-type) semiconductors rectify the alternating current.

47 Claims, No Drawings

ELECTROCHEMICAL CONVERSION USING ALTERNATING CURRENT AND SEMICONDUCTOR ELECTRODES

BACKGROUND OF THE INVENTION

The invention relates to the electrochemical conversion of reactants to products by utilizing alternating electrical current and semiconductor electrodes. More particularly, the invention relates to electrolytic processes and the electrocatalysis of redox reactions.

Electrochemical methods of manufacture are becoming ever increasingly important to the chemical industry due to their great ecological acceptability, potential for energy conservation and the resultant cost reductions possible. A great deal of effort has been applied to the hardware employed in such methods.

A major element of the hardware is the electrode itself. In general, requirements of an effective electrode include cost, stability, conductivity and electrocatalytic activity. An electrode cost within the range of commercial feasibility is desirable. Ordinarily, the electrode must be relatively stable toward its own oxidation or reduction by reactants, products and/or intermediates in an electrochemical cell. The conductivity of both the substrate and surface layers of the electrode is important from the viewpoint of minimizing voltage losses associated with the ohmic drop across the surface and the formation of surface insulating layers. The electrocatalytic activity of the electrode for a selected reaction contributes toward lowering the potential and raising product selectivity in an electrochemical cell.

Only a few materials may effectively constitute an electrode, particularly as an anode, because of the susceptibility of most substances to intense corrosive conditions. Among the effective electrode materials are graphite, nickel, lead, lead alloy, platinum or platinized titanium. Electrodes of this type have limited application because of such disadvantages as lack of dimensional stability high cost, low chemical activity, contamination of the electrolyte, contamination of the cathode deposit, sensitivity to impurities, lack of selectivity for the desired reaction, and ineffective generation of current densities or high overpotentials when employed in cells overpotentials typically refer to the excess electrical potential over the theoretical potential at which the desired product is discharged at the electrode surface). Effective current densities of electrodes employed in a large number of commercial electrochemical cells are ordinarily greater than about 50 milliamps/square centimeter ($mA/cm^2$).

Electrochemical cells operate on direct current electricity (DC) at relatively high currents and relatively low voltages. Economic incentives for electrochemical cells operating on alternating current electricity (AC) are high, provided rectification costs of AC to DC can be minimized. For example, the rectification and power conditioning equipment for a water electrolysis plant may be at least about 15 percent of the total hardware or capital costs of the plant and typically nearly 40 percent of the cost of the cell itself. Although a number of compounds have been electrosynthesized using alternating current with conventional electrodes, electrosynthetic processes have demonstrated substantial loss of current efficiency when AC frequencies are increased. For example, the current efficiency in a cell containing platinum flag electrodes for producing propylene oxide with alternating current decreases from 22 percent at a frequency of 1 Hz to 2 percent at a frequency of 40 Hz. (See Alkire and Tsai, *J. Electrochemical Soc.*, Vol. 129, p. 1157 (1982)).

Many attempts and proposals have been disclosed to overcome some of the problems associated with electrochemical cells, none of which seems to have accomplished an optimization of the desirable characteristics for such cells. Presently, there is interest in the development of rectifiers of alternating current electricity and numerous rectification means have been employed.

However, a need still exists for electrochemical cells employing inexpensive electrodes capable of rectifying alternating current electricity that have suitable electrocatalytic properties for selected reactions in such cells.

Accordingly, it is an objective of the invention to provide an apparatus which utilizes relatively inexpensive materials for rectification of alternating current electricity and which is nevertheless stable during electrochemical processes and, additionally, is preferably electrocatalytic to a number of reactions, such as oxidation or reduction of organic molecules, water, and the like.

It is a further objective of the invention to provide an electrochemical apparatus comprising an electrode capable of generating significant direct electricity current from alternating current when immersed in an electrochemical solution.

A further object still is to provide an electrochemical process for converting reactants to products with a cell containing an electrode capable of rectifying alternating current electricity.

A still further object is to provide an electrochemical cell employing an electrode capable of rectifying alternating current electricity and, more particularly, to provide a cell employing such an electrode capable of generating significant current densities.

These and other objects and advantages of the invention will become apparent from the following description.

SUMMARY OF THE INVENTION

Briefly, the present invention is directed to an electrochemical cell employing an electrode containing a non-degenerate semiconductor capable of rectifying alternating current electricity to direct current electricity useful in the cell. In one embodiment, the invention involves an apparatus containing a source of alternating electrical current and an electrochemical cell containing an electrode having either an n-type or a p-type semiconductor functioning as a cathode or an anode, respectively. In another embodiment, the invention involves the electrochemical conversion of reactants to products by rectifying alternating electrical current at the non-degenerate semiconductor electrode.

The process of the invention has an advantage of producing substantially high current efficiencies for reactions driven by alternating current cycled in the useful range of about 40 to about 80 Hz.

DETAILED DESCRIPTION OF THE INVENTION

The invention is directed to an electrochemical cell having at least one electrode containing a substrate having a non-degenerate semiconductor, and preferably to an electrochemical cell having electrodes containing electrocatalytic coating materials on a substrate containing a non-degenerate semiconductor. The invention is further directed to electrochemically converting reactants to products in such an electrochemical cell by rectifying an alternating electrical current at the nondegenerate semiconductor electrode so as to provide direct electrical current for the electrochemical conversion. The electrochemical cell is particularly well suited as an electrolytic cell converting water to hydrogen and oxygen.

The electrode used in the invention is typically employed at the cathode of an electrochemical cell and a counter electrode such as platinum metal is employed at the anode, although the counter electrode may also contain a semiconductor material. The electrodes of the cell are usually immersed in a liquid containing an electrolyte and at least one redox-couple. (The liquid and/or electrolyte may also serve as at least a portion of the redox-couple.) In operation, a source of alternating electrical current, external to the cell, usually passes to the electrode wherein the alternating electric current is rectified (provided the breakdown voltage is not exceeded). The rectification results in the generation of a direct electric current from the electrode to at least one electrolyte component and/or at least one redox-couple in the electrochemical cell.

Whatever the source of alternating electrical current, the substrate material of the electrode must be capable of rectifying such current up to the breakdown voltage of the electrode. Substrates useful in the present electrodes include materials containing at least one semiconductor. Ordinarily, the substrate is in the form of a single crystalline, polycrystalline, or amorphous structure, or combinations thereof. Oftentimes, two or more semiconductor materials are combined together in various proportions or layers resulting in a final substrate having a desired volume resistivity. The resistivity of the nondegenerate semiconductor material contained in the substrate, as a measure of its conductivity, is generally greater than about $10^{-2}$ ohm-cm, and preferably greater than about $10^{-1}$ ohm-cm. A suitable resistivity range is between about $10^{-2}$ ohm-cm and about 100 ohm-cm. The semiconductor material contained in the substrate may be either intrinsic materials or suitably doped n-type or p-type materials. In the present invention, suitably doped n-type semiconductors are contained in electrodes functioning as a cathode, while suitably doped p-type semiconductors are contained in electrodes functioning as an anode in a cell. The rectifying junction is provided by the contact of either the n-type or p-type semiconductor with the solution, and it is not necessary to use solid-state rectifying junctions such as n-p, p-n, n-p-n, or p-n-p junctions.

Furthermore, the substrate semiconductor material is essentially non-degenerate. Degeneracy, as used herein, is the condition of a material wherein its Fermi energy level is at least, and preferably greater than that of the minimum energy of its conduction band for an n-type material or, in the case of p-type materials, the Fermi level is at most, and preferably less than, that of the maximum energy of its valence band.

Semiconductor materials of the invention preferably contain (1) elemental semiconductors such as selenium, silicon and germanium, (2) the binary group semiconductors such as Group III-V semiconductors including, for example, GaAs, InP, GaP and AlSb, (3) the Group II-VI semiconductors including, for example, CdS, CdSe and CdTe, (4) the metal-containing chalcogenides, particularly those containing transition metals such as the selenides, tellurides and sulfides of tungsten and molybdenum, (5) the Group I-III-VI ternary semiconductors such as $CuInS_2$, $CuInSe_2$ and $CuInTe_2$, or (6) metal-oxide containing semiconductors such as $TiO_2$, NiO and the like. Highly preferred semiconductor materials of the present invention may be selected from the group consisting of silicon, $TiO_2$, GaAs, InP, CdSe and GaP. The most highly preferred semiconductor materials are silicon and $TiO_2$, especially those containing electrocatalytic coating materials.

The electrode used in the electrochemical cell may contain a highly conductive coating material. Preferably, the coating material comprises at least a portion of the outermost layer on the electrode. The coating material and/or the substrate material preferably have a catalytic property for promoting chemical reactions, especially oxidation or reduction reactions associated with a selected redox-couple employed in an electrochemical cell. When contacted with a redox-couple in a liquid, substrates utilized in the invention, without a coating material, may provide a catalytic effect upon such oxidation or reduction reactions. However, when a coating material is present on the substrate, the catalytic properties of the electrode are usually substantially increased, as evidenced by the efficiencies of the energy conversion reactions associated with the selected redox-couples being increased, usually by at least 10, preferably by at least 100 and most preferably by at least 500 times that of a comparative but uncoated electrode. Due to such catalytic properties, an electrode used in the invention may be termed an "electrocatalytic electrode." When the electrode is employed in an electrochemical cell wherein the desired oxidation-reduction reactions of the cell have been known to be promoted with catalytic materials other than the substrate material, such catalytic materials may be combined with the substrate material required in the invention to further improve the efficiency of the cell.

Substrate semiconductors and catalytic coating materials useful in the invention must be stable electrochemically and inert to undesired reactions with the other portions of the electrochemical cell. Such undesired reactions include oxidation or reduction reactions with an electrolyte, a liquid of the cell, or any reactant or product of the desired energy conversion reaction.

Also, during operation of a cell employing an electrode having an uncoated substrate, layers of insulating materials may form on the surface of the uncoated substrate. Such layers often contribute to substantial reduction in the stability of the electrode and/or in the efficiency of the desired reaction in the cell. However, when a coating material is contained on the electrode used in the invention the coating material contacts and at least, in part, covers such layers of the insulator material. Such insulator materials whether intentionally or unintentionally formed on the substrate, usually has an average thickness less than about 100 angstroms, preferably less than 50 angstroms and most preferably from about one to about 20 angstroms, as measured by ellipsometry and conventional surface spectroscopy techniques as, for example, the Auger depth profiling technique.

Another example of the effects of the coating material over insulating materials is demonstrated when the surface of an uncoated n-type silicon-containing substrate is oxidized in contact with air, oxygen or another oxidizing agent from a redox-couple so as to produce a thin layer of an oxide of silicon such as silicon dioxide. Although the silicon dioxide-coated, n-type silicon substrate employed in a water electrolysis cell provides suitable current efficiencies for energy conversion processes, an electrocatalytic coating material, such as platinum, covering the silicon dioxide layer, produces an electrode for a water electrolysis cell that operates at lower overpotentials and/or higher current efficiencies, as compared to an electrode containing the same substrate not containing a coating material.

To prepare the electrode, the substrate portion of the electrode forms an ohmic contact with conductive materials and together with other conducting means, such as a conducting wire lead, the electrode may conveniently be constructed with other components of an electrochemical cell. Also, the substrate may be compounded with a coating material. The compounding may be accomplished by conventional techniques including electrochemical deposition, vacuum evaporation, sputtering, chemical vapor deposition (CVD), spray pyrolysis and mechanical methods such as brushing, spraying and impregnation. Coating materials may also be compounded with the substrate by an electrochemical, electroless or a photo-assisted electrochemical or electroless deposition technique, as disclosed in U.S. Pat. No. 4,521,499, and incorporated by reference herein.

The semiconductor-containing electrodes may be employed in an electrochemical process for generating direct current electricity from an external alternating current source, or in an electrochemical process for promoting the production of chemical products in either exoergic or endoergic reactions. Typical examples include electroplating, electrolysis, batteries and fuel cells. In the case of batteries, the semiconductor-containing electrode provides a means for charging or recharging a battery by using alternating electrical current. As heretofore mentioned, when employed to promote the generation of direct current electricity, the electrodes disclosed herein may be used as an anode, cathode or both, ordinarily in contact with a liquid contacting a redox-couple, i.e. an electrode-liquid junction electrochemical cell. Also, the breakdown voltage of the electrode must be greater than the voltage effecting the desired chemical reaction in the cell.

The suitably doped n-type or p-type semiconductor-containing electrode effectively utilizes an available external source of alternating electrical current during operation of such a cell. The efficiency of such a cell is substantially greater than that of a cell employing an electrode not containing a suitably doped n-type or p-type semiconductor. In an electrochemical cell, the power input is the alternating electrical current while the power output depends upon the nature of the cell product, i.e. direct current electricity, or chemical products resulting from exoergic and endoergic reactions. As used herein, the percent efficiency of a cell may be defined according to the following equation:

$$\text{Efficiency (percent)} = \frac{(\text{moles of product}) \times (n) \times (F)}{\text{coulombs}} \times 100$$

wherein F is Faraday's number (96,487 coulombs/equivalent) and n is the number of electrons transferred from reacting species to product species/half reaction.

Also, the electrode may be employed as an anode (electrode containing p-type semiconductor), a cathode (electrode containing n-type semiconductor) or both, in a electrosynthetic cell wherein the chemical products result from an endoergic reaction in which chemical products of higher free energy are generated than that of the reactant materials. In one embodiment, an alternating electrical current is passed from an external source to a cathode containing an n-type semiconductor and a counter electrode containing platinum serving as an anode immersed in a liquid redox-couple, such as water. The alternating electrical current is rectified at the cathode and higher energy products such as hydrogen and oxygen gases are generated from the water at the respective electrodes.

Electrosynthetic cells employing the semiconductor-containing electrodes described herein may convert essentially any organic reactant to an oxidized or reduced organic product. Other examples of typical electrosynthetic conversion reactions employing the semiconductor-containing electrodes include hydrogen chloride converted to hydrogen and chlorine, hydrogen bromide converted to hydrogen and bromine, hydrogen iodide converted to hydrogen and iodine, water and propylene converted to propylene oxide and hydrogen, and water and carbon dioxide converted to methanol and oxygen. Still other reactions include those found in electrochemical cells disclosed in the book *Organic Electrochemistry,* edited by M. M. Baizer and published by Marcel Dekker, Inc., New York, N.Y. (1973), and incorporated by reference in its entirety herein.

In an electrocatalytic cell employing the electrodes described herein, the chemical products result from an exoergic reaction and often the cell allows a more economic preparation of some useful chemical products. For example, an electrocatalytic cell converting propylene and oxygen to the highly useful chemical product, propylene oxide (and water), is made more economically feasible employing a semiconductor electrode that rectifies alternating electrical current. In general, an electrocatalytic conversion reaction involving oxygen with essentially any oxidizable organic material or molecule converted to the oxidized organic product (and water) may be promoted by rectification of alternating electrical current with an electrode containing either a suitably doped n-type or p-type semiconductor in an electrocatalytic cell.

Any suitable electrochemical cell apparatus may be utilized in the invention. For example, the apparatus may include a single 2-electrode cell or a plurality of 2-electrode or multiple electrode cells (connected by series or parallel connections). The cell apparatus contains means for operably electrically connecting the electrodes to a source of alternating electrical current, including means for receiving the alternating electrical current that is supplied to the electrode or electrodes in the cell. Furthermore, the apparatus contains means for utilizing the direct electrical current generated from rectification of the alternating current. For instance, alternating electrical current from an AC source is transferred to the cell electrode through a conductive wire and the direct electrical current generated from the cell may be transmitted through a conductive wire to another location or transferred to chemical species in the cell at the junction of the electrode with the species (typically contained in a liquid solution or molten salt).

An advantage of the apparatus and method of the invention is the maintenance of relatively high current efficiencies for products of cells to which the alternating electrical current is cycled at useful frequencies, such as in the range from about 40 to about 80 Hz. In general, alternating electrical current is cycled to the cell in the invention at above about 5 Hz, preferably about 30 to about 450 Hz, and more preferably about 40 to about 80 Hz. AC current efficiencies for the electrochemical conversion of chemical reactants to desired chemical products is usually greater than 25 percent, preferably greater than 50 percent, and most preferably greater than 75 percent, when the alternating current is cycled to the cell at suitable frequencies, i.e. greater than 5 Hz and usually between about 30 and about 450 Hz.

The invention is further illustrated by the following examples which are illustrative of specific modes of practicing the invention and are not intended as limiting the scope of the invention defined by the appended claims.

EXAMPLE I

An electrode for an electrochemical cell is prepared as follows:

An ohmic contact is formed with aluminum by vacuum evaporation on the back of a polished and etched silicon substrate material that contains n-type crystals doped with phosphorus to a volume resistivity of 1.19 to 2.02 ohm-cm. A copper wire lead is attached to the ohmic contact with conducting silver epoxy and sealed in a glass tube with insulating epoxy and silicone sealant.

A water-splitting electrochemical cell is constructed with the aforementioned electrode. The cell employs the aforementioned n-type silicon electrode and a platinum counter electrode. Also, the electrodes are immersed in an acid/water solution (1.0 M $H_2SO_4$).

The geometric area of the n-silicon electrode exposed to the acidic water solution is 0.081 $cm^2$ and that of the platinum counter electrode is 0.2 $cm^2$.

The copper wire leads are connected to a source of 60 cycles per second (Hz) alternating current electricity cycled at ±5.6 peak volts. During operation of the cell, cathodic currents having current densities up to approximately 294mA/$cm^2$ are observed when voltages between −5.6 V and 0.0 V are applied whereas current densities of essentially 0.0mA/$cm^2$ are observed when voltages between 0.0 V and +5.6 V are applied. A total of 900 coulombs/$cm^2$ are passed by the electrodes and the gas collected at the n-type silicon electrode is identified by mass spectrometry to be 99.6 mole percent hydrogen (corrected for water vapor pressure), thus indicating the cathode function of the n-silicon electrode. The gas collected at the platinum counter electrode is identified to be 99.5 mole percent oxygen, thus indicating the electrode's anodic function. The hydrogen/oxygen ratio throughout the operation of the cell is 2.07±0.04 and the current efficiency for hydrogen production is essentially 100 percent.

In a second operation, a peak voltage of ±4.88 is applied to the cell (AC current cycled at 60 Hz) and cathodic currents having current densities up to approximately 700mA/$cm^2$ are observed when voltages between 0.0 V and −4.88 V are applied. Again, when voltages between 0.0 V and +4.88 V are applied, a current density of essentially 0.0mA/$cm^2$ is observed. Also, hydrogen gas is collected at the n-type silicon electrode (cathode) an an approximate 2:1 ratio to the oxygen gas collected at the platinum counter electrode (anode).

In a control operation of the aforementioned electrochemical cell using two platinum electrodes (i.e. the n-type silicon electrode is replaced with a platinum electrode), the 60 Hz alternating current electricity is cycled at ±5.5 volts. Both anodic and cathodic currents having current densities up to approximately 800mA/$cm^2$ are observed. After 2,900 cathodic coulombs/$cm^2$ and 2,635 anodic coulombs/$cm^2$ are passed, only about 0.2 ml of gas is collected.

Although both anodic and cathodic currents from the alternating current source are passed by both metallic electrodes (platinum) in the control operation, the data indicate that essentially no anodic current is detected at the n-type silicon electrode (until the breakdown potentially is reached).[1] The n-type silicon electrode functions as an in situ half-wave rectifier for the water-splitting electrochemical reaction (or reactions) evolving hydrogen. In further operations of the water-splitting cell it has been observed that such rectifying properties of the n-type silicon/water junction are maintained up to frequencies of 60,000 Hz.

[1] In the aforementioned electrochemical cell, anodic currents are not observed until an observed breakdown potential at approximately +9.6 V vs. SCE (Standard Calomel Electode) is reached.

While particular embodiments of the invention have been described, it will be understood, of course, that the invention is not limited thereto since many obvious modifications can be made, and it is intended to include within this invention any such modifications as will fall within the scope of the invention as defined by the appended claims.

I claim:

1. A method for electrochemical conversion of chemical reactants to chemical products, said method comprising passing a source of alternating electrical current external to at least one electrode containing a nondegenerate semiconductor in an electrochemical cell, said electrode rectifying said alternating electrical current to generate direct electrical current, said direct electrical current providing energy to convert at least one chemical reactant contained in said electrochemical cell to at least one chemical product.

2. The method defined in claim 1 wherein said electrode is an anode containing a p-type semiconductor and said direct electrical current is pulsed anodic current.

3. The method defined in claim 1 wherein said electrode is a cathode containing an n-type semiconductor and said direct electrical current is pulsed cathodic current.

4. The method defined in claim 1 wherein said electrochemical cell contains a first electrode and a second electrode, said first electrode is a cathode containing an n-type semiconductor and said second electrode is an anode containing a p-type semiconductor.

5. The method defined in claim 4 wherein said nondegenerate semiconductor is selected from the group consisting of silicon and $TiO_2$.

6. The method defined in claim 1 wherein said electrode functions as an anode and contains a p-type semiconductor and an electrocatalytic coating material.

7. The method defined in claim 1 wherein said electrode functions as a cathode and contains an n-type semiconductor and an electrocatalytic coating material.

8. The method defined in claim 1 wherein said chemical reactant is water and said chemical product is selected from the group consisting of hydrogen gas and oxygen gas.

9. The method defined in claim 1 wherein said chemical product is deposited on said electrode.

10. The method defined in claim 1 wherein said electrochemical conversion comprises electrolysis.

11. The method defined in claim 1 wherein said electrochemical conversion comprises electroplating.

12. The method defined in claim 1 wherein said electrode consists essentially of a p-type semiconductor or an n-type semiconductor.

13. The method defined in claim 1 wherein said alternating electrical current is cycled at greater than about 5 Hz.

14. The method defined in claim 1 wherein said alternating electrical current is cycled at about 30 to about 450 Hz.

15. The method defined in claim 1 wherein said alternating electrical current is cycled at about 40 to about 80 Hz.

16. The method defined in claim 1 wherein the resistivity of said non-degenerate semiconductor is greater than about $10^{-2}$ ohm-cm.

17. The method defined in claim 1 wherein said electrode further comprises an electrocatalytic material selected from the group consisting of metals and semiconductors.

18. An apparatus comprising (1) an electrochemical cell having at least one electrode containing a non-degenerate semiconductor capable of rectifying alternating electrical current, (2) means for supplying alternating electrical current to said electrode in said electrochemical cell, and (3) means for utilizing direct electrical current generated from said electrode.

19. The apparatus defined in claim 18 wherein said electrochemical cell contains a first electrode and a second electrode, said first electrode is a cathode containing an n-type semiconductor and said second electrode is an anode containing a p-type semiconductor.

20. The apparatus defined in claim 18 wherein said electrode is an anode containing a p-type semiconductor and said alternating electrical current is rectified at said electrode to provide a source of electrons for an electrochemical conversion of at least one reactant to at least one product in said electrochemical cell.

21. The apparatus defined in claim 18 wherein said electrode is a cathode containing an n-type semiconductor and said alternating electrical current is rectified at said electrode to provide a source of electrons for an electrochemical conversion of at least one reactant to at least one product in said electrochemical cell.

22. The apparatus defined in claim 18 wherein said electrochemical cell is an electrolytic cell.

23. The apparatus defined in claim 18 wherein said electrochemical cell is an electroplating cell.

24. The apparatus defined in claim 18 wherein said means for supplying alternating electrical current is external to said electrochemical cell and is capable of cycling said alternating electrical current to said electrode at greater than 5 Hz.

25. The apparatus defined in claim 18 wherein said means for supplying alternating electrical current is capable of cycling said alternating electrical current to said electrode at about 40 to about 80 Hz.

26. The apparatus defined in claim 18 wherein said non-degenerate semiconductor is selected from the group consisting of silicon and $TiO_2$.

27. The apparatus defined in claim 18 wherein said electrode functions as an anode and contains a p-type semiconductor.

28. The apparatus defined in claim 18 wherein said electrode functions as a cathode and contains an n-type semiconductor.

29. The apparatus defined in claim 18 wherein the resistivity of said non-degenerate semiconductor is greater than about $10^{-2}$ ohm-cm to less than about 100 ohm-cm.

30. The apparatus defined in claim 18 wherein said electrode further comprises an electrocatalytic material selected from the group consisting of metals and semiconductors.

31. The apparatus defined in claim 18 wherein said electrode consists essentially of a p-type semiconductor or an n-type semiconductor.

32. The apparatus defined in claim 27 wherein water is a reactant in said electrochemical cell and oxygen gas is produced at said electrode.

33. The apparatus defined in claim 28 wherein water is a reactant in said electrochemical cell and hydrogen gas is produced at said electrode.

34. An apparatus comprising (1) an electrochemical cell having at least one electrode containing a non-degenerate semiconductor capable of rectifying alternating electrical current, (2) means for receiving altnerating electrical current supplied to said electrode in said electrochemical cell, and (3) means for utilizing direct electrical current generated from said electrode.

35. The apparatus defined in claim 34 wherein said electrochemical cell contains a first electrode and a second electrode, said first electrode is a cathode containing an n-type semiconductor and said second electrode is an anode containing a p-type semiconductor.

36. The apparatus defined in claim 34 wherein said electrode is an anode containing a p-type semiconductor and said alternating electrical current is rectified at said electrode to provide a source of electrons for an electrochemical conversion of at least one reactant to at least one product in said electrochemical cell.

37. The apparatus defined in claim 34 wherein said electrode is a cathode containing an n-type semiconductor and said alternating electrical current is rectified at said electrode to provide a source of electrons for an electrochemical conversion of at least one reactant to at least one product in said electrochemical cell.

38. The apparatus defined in claim 34 wherein said electrochemical cell is an electrolytic cell.

39. The apparatus defined in claim 34 wherein said electrochemical cell comprises a battery.

40. The apparatus defined in claim 34 wherein said means for receiving alternating electrical current is external to said electrochemical cell and is capable of receiving cycled alternating electrical current transferred to said electrode at greater than 5 Hz.

41. The apparatus defined in claim 34 wherein said means for receiving alternating electrical current is capable of receiving cycled alternating electrical current transferred to said electrode at about 40 to about 80 Hz.

42. The apparatus defined in claim 34 wherein said non-degenerate semiconductor is selected from the group consisting of silicon and $TiO_2$.

43. The apparatus defined in claim 34 wherein said electrode functions as an anode and containing a p-type semiconductor.

44. The apparatus defined in claim 34 wherein said electrode functions as a cathode and contains an n-type semiconductor.

45. The apparatus defined in claim 34 wherein the resistivity of said non-degenerate semiconductor is greater than about $10^{-2}$ ohm-cm to less than about 100 ohm-cm.

46. The apparatus defined in claim 34 wherein said electrode further comprises an electrocatalytic material selected from the group consisting of metals and semiconductors.

47. The apparatus defined in claim 34 wherein said electrode consists essentially of a p-type semiconductor or an n-type semiconductor.

* * * * *